United States Patent [19]

Moore

[11] 4,004,544

[45] Jan. 25, 1977

[54] TWIN TURBINE-WHEEL DRIVEN BOAT

[76] Inventor: John J. Moore, 44 W. 77th St., New York, N.Y. 10024

[22] Filed: Dec. 24, 1975

[21] Appl. No.: 644,057

[52] U.S. Cl. ..... 115/50; 115/53; 114/58

[51] Int. Cl.[2] ..... B63H 5/04

[58] Field of Search ..... 115/49, 50, 53, 54, 115/16, 23; 114/58, 140; 188/354, 296

[56] References Cited

UNITED STATES PATENTS

| | | | |
|---|---|---|---|
| 2,556,287 | 6/1951 | Milster | 188/354 |
| 2,769,421 | 11/1956 | Grieve | 115/16 |
| 2,858,675 | 11/1958 | Schneider | 188/296 X |
| 2,980,049 | 4/1961 | Ward et al. | 114/140 |
| 3,759,213 | 9/1973 | Quady | 115/16 |

*Primary Examiner*—George E. A. Halvosa
*Assistant Examiner*—Sherman D. Basinger

[57] ABSTRACT

A rudderless motorboat propelled and steered by twin-turbine wheels also functioning as traction wheels to carry the boat over sandbars and other submerged bodies to prevent it from running aground. The stern section of the boat hull is provided with a pair of longitudinally-extending tunnels which are symmetrically disposed with respect to the keel. Each wheel is rotatably mounted within a respective tunnel on an axis of rotation which is above the bottom line of the hull whereby only the lower segment of the wheel projects below this line to effect propulsion. Disposed within each tunnel on either side of the wheel therein are inlet and outlet baffles which are contoured to admit water to the propelling segment of the wheel and to discharge water therefrom, the baffles otherwise conforming to the periphery of the wheel to prevent recirculation of the water. A horizontally-mounted inboard motor is operatively coupled to the wheels in a manner whereby the wheels are differentially driven to propel and steer the boat.

10 Claims, 5 Drawing Figures

TWIN TURBINE-WHEEL DRIVEN BOAT

BACKGROUND OF INVENTION

This invention relates generally to inboard motor-driven vessels, and more particularly to a rudderless motorboat propelled and steered by twin turbine-wheels also functioning as traction wheels to carry the boat over sandbars and other submerged bodies to prevent it from running aground.

The typical motorboat is propelled by means of screw propellers driven by inboard or outboard motors. In an outboard motor installation, the engine is usually supported on the stern board of the hull with a resultant poor weight distribution, particularly in the case of a large horsepower motor. In an inboard motor arrangement, the screw-propeller is mounted at the end of an inclined shaft which extends into the boat through the keel or bottom ribs of the hull at a slight angle thereto, usually about 15°. Consequently, the inboard engine coupled to the shaft must be mounted within the hull at an inclined position.

An inboard motor has the advantage of providing a better weight distribution than an outboard motor installation. On the other hand, because the drive shaft in an inboard motor passes through an opening which pierces the keel or bottom ribs of the hull, this somewhat weakens the hull structure. Also, in an inboard motor arrangement, the engine power is not fully utilized in propelling the boat, since the screw propeller is at an angle relative to the water line.

Moreover, in a conventional inboard motor installation, since the front of the engine is somewhat higher than the rear thereof, oil starvation is often experienced which may be damaging to the engine. With an inclined engine mounting, float problems and erratic fuel supply encountered at high speeds or in choppy waters give rise to rusty pump and jet parts and eventually to engine breakdown.

But the more serious drawback of existing inboard and outboard motor boats which make use of screw propellers, rudders, shafts and other mechanical elements which project into the water below the bottom of the hull, is that these elements are exposed and subject to mutilation and crippling by floating debris or other water-borne bodies. Furthermore, in shallow water, should the boat run over a sandbar or a submerged rock, the elements projecting below the boat may be seriously damaged thereby and the boat run aground. Most boating accidents are imputable to the vulnerability of the mechanical elements of the board which project below the bottom of the hull.

Thus the inherent nature of existing types of motor-driven boats is such as to render these boats accident prone and inefficient in terms of power utilization.

SUMMARY OF INVENTION

In view of the foregoing, it is the main object of this invention to provide a rudderless motorboat propelled and steered by twin turbine-wheels which also function as traction wheels to carry the boat over sandbars and other submerged bodies to prevent it from running aground.

A significant feature of a boat in accordance with the invention is that the only mechanical elements which project below the bottom of the hull are the lower segments of the rotating wheels, these segments being virtually immune to damage from floating debris and other objects, thereby minimizing the possibility of damage and breakdown.

More particularly, an object of this invention is to provide a boat of the above type in which the stern section of the hull has formed therein a pair of tunnels within each of which is rotatably mounted a turbine wheel whose axis of rotation is above the bottom of the hull whereby only a lower segment of the wheel projects into the water to effect propulsion, the tunnels being baffled to confine the water to the operative portion of the wheels to prevent recirculation of the water thereby.

Another object of this invention is to provide a motorboat in which the inboard engine for driving the twin turbine-wheels is horizontally mounted within the hull and is so placed therein as to effect a proper weight distribution, thereby obviating the problems arising from inclined motor installations or from outboard motors.

A salient feature of a twin turbine drive in accordance with the invention is that drive power is optimally applied in line with the hull at about the water line rather than below or behind the boat or at an angle with respect to the water line. Also, since the inboard engine installation does not require piercing of the keel or bottom ribs of the hull, the strength of the hull is not impaired thereby.

Yet another object of the invention is to provide a boat whose twin turbine-wheels are operatively coupled to a common inboard engine through separately controlled hydraulic brakes, making it possible to drive the twin wheels differentially in order to both propel and steer the boat.

Briefly stated, these objects are attained in a rudderless boat in which the stern section of the hull has a pair of longitudinally-extending tunnels formed therein which are symmetrically disposed with respect to the keel. Rotatably mounted within the tunnels are a pair of turbine wheels, their axes of rotation being above the bottom line of the hull whereby only a lower segment of each wheel projects below this line to effect propulsion of the boat.

OUTLINE OF DRAWING

For a better understanding of the invention as well as other objects and further features thereof, reference is made to the following detailed description to be read in conjunction with the accompanying drawings, wherein.

DESCRIPTION OF INVENTION

Figure 1:
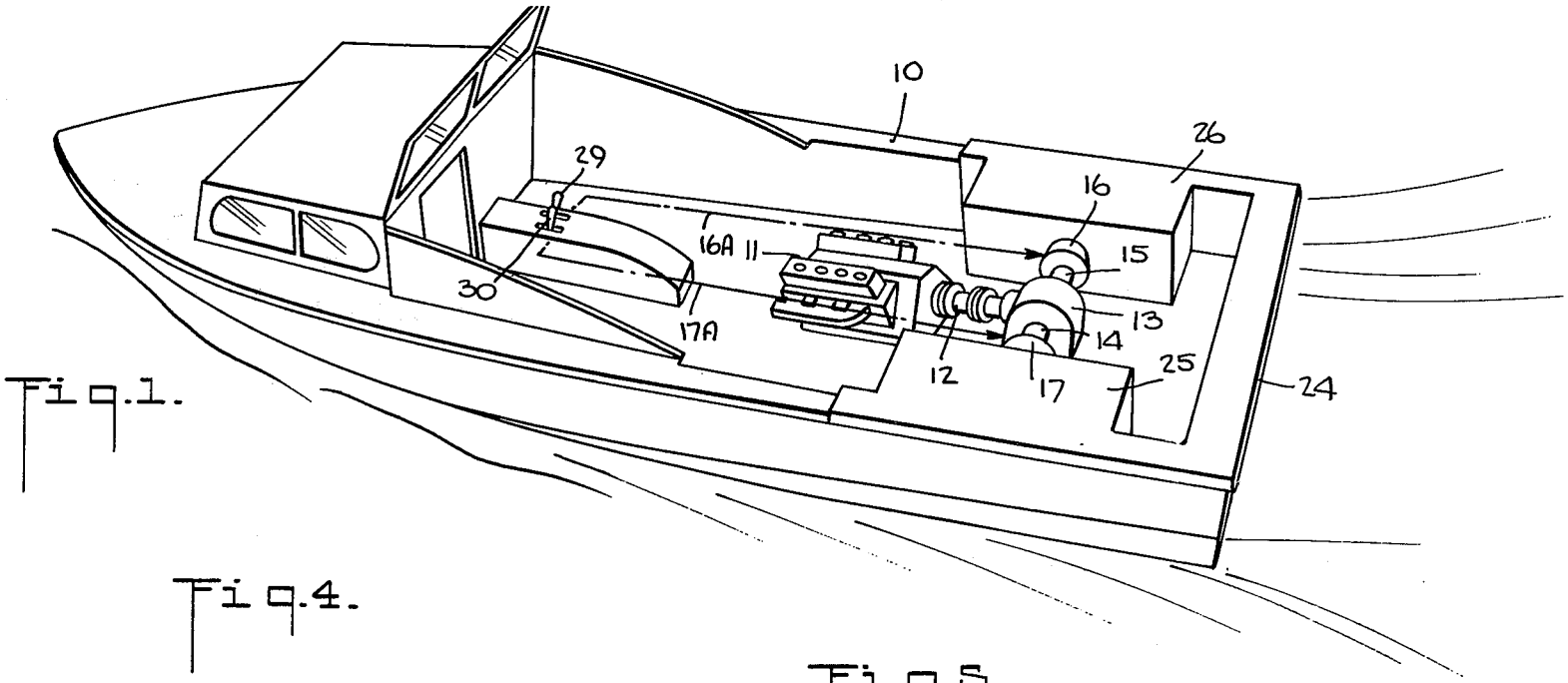
FIG. 1 is a perspective view of a boat driven by twin turbine wheels in accordance with the invention, as seen backing into the hull.

Referring now to the drawings, there is shown a boat in accordance with the invention which is rudderless and therefore does not include a rudder wheel. Horizontally mounted within hull 10 of the boat is an internal combustion marine engine 11 of appropriate horsepower having an output shaft 12. Engine shaft 12 is operatively coupled to a differential gear mechanism 13 having a pair of output shafts 14 and 15 which are at right angles to engine shaft 12 and are coupled through respective hydraulic brakes 16 and 17 to a pair of turbine wheels 18 and 19.

Figure 3:
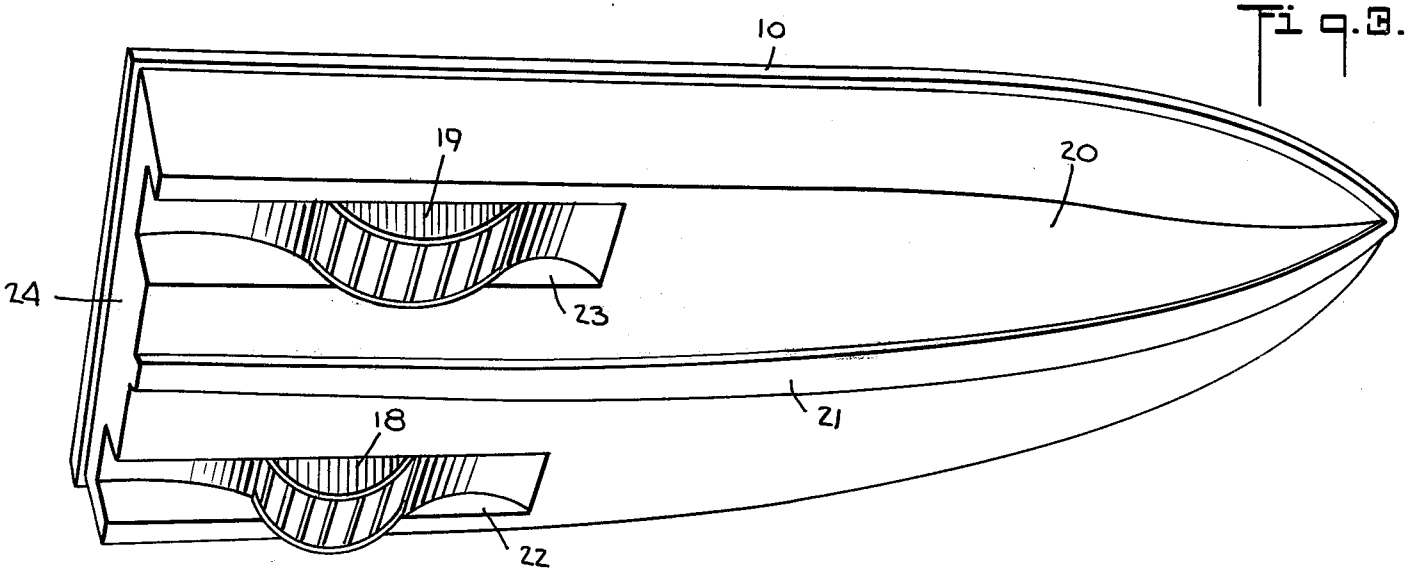
FIG. 3 is a perspective view, as seen looking toward the underside of the hull.

As best seen in FIG. 3, attached to the bottom surface 20 of the hull is a keel shoe 21 which is preferably fabricated of stainless steel. Disposed symmetrically with respect to this shoe in the stern section of the hull are a pair of tunnels 22 and 23 which extend longitudinally along the hull and through the stern board 24.

Turbine wheels 18 and 19 are rotatably mounted within tunnels 22 and 23, the axis of rotation of each wheel being above the line of the hull bottom 20 so that only a lower segment of each wheel projects therebelow. The upper segment of each wheel projects through a gap in the tunnel, the tunnel gap being covered by and sealed by casing 25 and 26.

Each wheel is constituted by a pair of relatively heavy discs $D_1$ and $D_2$ in parallel relation, which discs are bridged by a circumferential array of paddle blades P to provide a high-strength structure capable of acting as a traction as well as a turbine wheel. Thus should the boat in shallow water run over a sandbar or other submerged ground, the wheels will carry the boat thereover to prevent it from running aground. Damage to the hull is prevented by the steel keel shoe 21.

Because of the turbine wheel arrangement, it is only the lower segments of the wheels which are exposed and even if the paddle blades strike rocks or debris and are nicked or bent thereby, the smooth running operation of the wheels will not be materially affected; nor will the loss of one or more blades disable the boat. The wheel structure may be arranged to permit replacement of individual paddle blades, when necessary.

Figure 5:
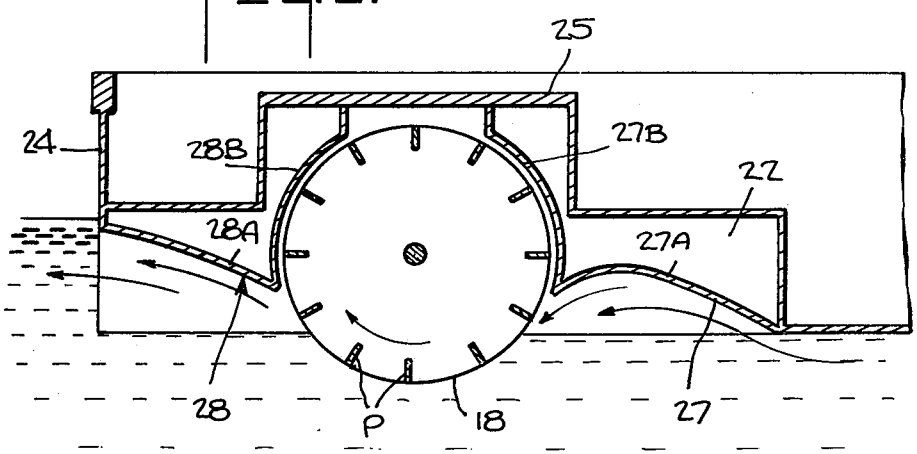
FIG. 5 is a section taken in the plane indicated by line 5—5 in FIG. 4.
Figure 4:
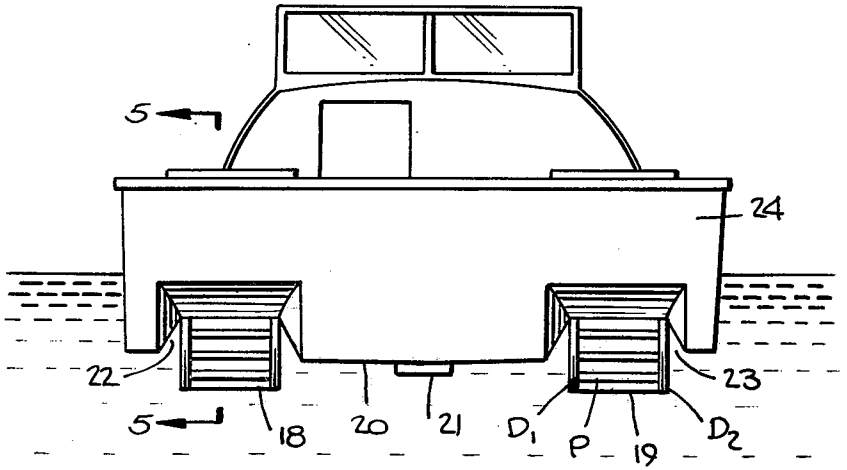
FIG. 4 is an end view of the boat.
Figure 2:
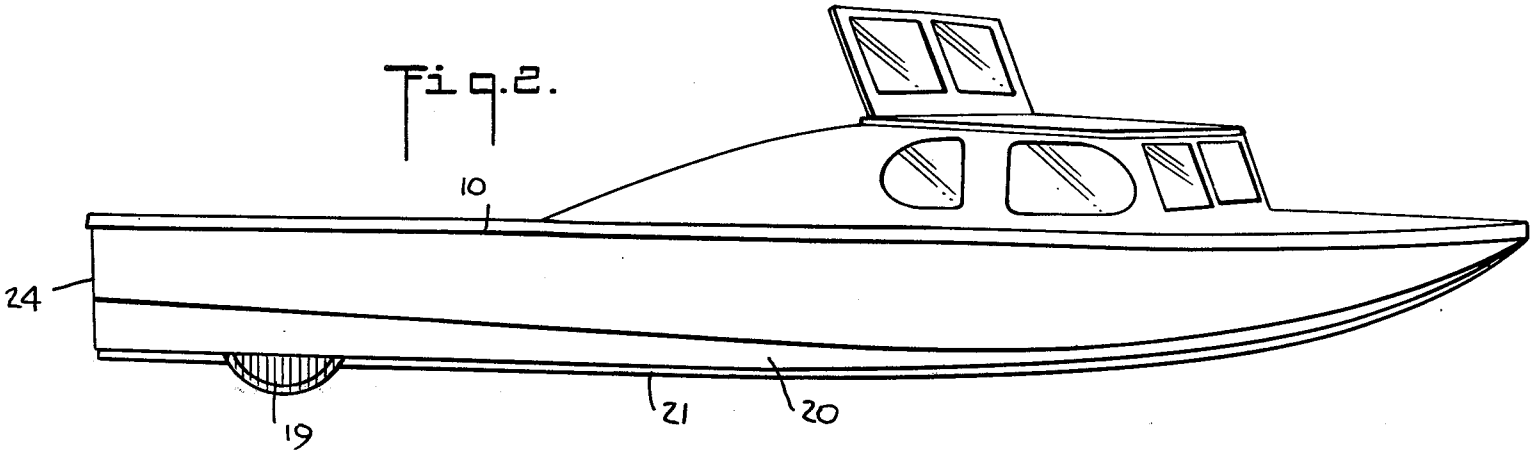
FIG. 2 is an elevational view of the boat.

As best seen in FIG. 5, associated with each wheel in the tunnel is a forward or inlet baffle having two contoured sections 27A and 27B, the first section functioning to direct incoming water tangentially toward the operative lower segment of the wheel, and the second section following the curvature of the wheel above this segment to isolate the wheel from the incoming water. Also placed in the tunnel is a rear or outlet baffle 28 having two contoured sections 28A and 28B, the first of which acts to direct water discharged from the operative lower segment toward the stern of the boat and the second functioning to isolate the wheel from the water discharged thereby.

Thus the turbine wheels act to positively displace the incoming water and thereby advance the boat without, however, recirculating the water or causing cavitation. This is a significant feature of the invention, for in the absence of the baffles, the wheels would tend to recirculate the water, especially when the boat is at rest and the rotation of the wheels is initiated on take-off, for then the wheels would tend to spin within the tunnels without producing a propelling force. Also because only a segment of each wheel engages the water, the wheels act as flywheels or stabilizers.

Hydraulic brakes 16 and 17 are coupled through suitable hydraulic lines 16A and 16B (indicated schematically) to manual control sticks or levers 29 and 30 so that the brakes may be separately manipulated. To propel the boat in the forward or rear direction, depending on how the differential transmission is operated, the brakes are released to permit both wheels to turn concurrently, while to steer the boat one or the other brake is operated to provide a differential wheel action causing the boat to veer in one or the other direction. In practice, foot pedals rather than hand sticks may be used to operate the brakes. This hydraulic arrangement acts to obviate the need for quadrants, pulleys and other mechanical expedients heretofore used in steering apparatus.

Should one wish to use a ship steering wheel rather than two levers or control sticks, this can be accomplished by small hydraulic control units or slave cylinders associated with the wheel shaft. The engine water intake may be located in the baffle in one of the tunnels rather than in the bottom of the boat.

While there has been shown and described a preferred embodiment of a twin turbine-wheel driven boat in accordance with the invention, it will be appreciated that many changes and modifications may be made therein without, however, departing from the essential spirit thereof. For example, one may provide an idler wheel in the bow which is retractable so that the wheel can be extended only when it is desired to drive the boat out of the water onto the beach.

I claim:

1. A rudderless motorboat comprising:

A. a hull having a stern board, a keel and a pair of longitudinally-extending tunnels indented in the bottom of the hull and symmetrically disposed in the stern section of the hull with respect to the keel and extending through the stern board;

B. a turbine wheel rotatably mounted in each of said tunnels at a position intermediate the inlet and outlet thereof, only the lower segment of each wheel projecting below the bottom of the hull, said wheels functioning to propel the boat and also functioning as traction wheels to carry the boat over submerged bodies to prevent it from running aground, each wheel being formed by a pair of discs and circumferentially arranged paddle blades bridging said discs;

C. inlet and outlet baffle means disposed within each tunnel on the inlet side and outlet side of the wheel and contoured to admit water passing through the longitudinally-extending tunnel to the propelling segment of the wheel and to discharge water therefrom toward the stern board; the baffle means otherwise conforming to the periphery of the wheel to prevent recirculation of the water;

D. an inboard engine; and

E. means operatively coupling said engine to said wheels whereby said wheels may be concurrently driven to propel said boat or differentially driven to steer said boat without the need for a rudder.

2. A motorboat as set forth in claim 1, wherein said hull is provided with a stainless steel keel shoe to protect the hull.

3. A motorboat as set forth in claim 1, wherein said blades are individually replaceable.

4. A motorboat as set forth in claim 1, wherein said wheel is mounted for rotation along an axis which is above the bottom of said hull.

5. A motorboat as set forth in claim 1, wherein said engine is coupled to said wheels through a differential gear mechanism.

6. A motorboat as set forth in claim 5, wherein each wheel is operatively coupled to said mechanism through a separately manipulated hydraulic brake to permit a differential wheel action for steering the boat without a rudder.

7. A motorboat as set forth in claim 6, further including a remote control stick hydraulically coupled to said brake.

8. A motor as set forth in claim 1, wherein the upper segment of each wheel projects through a gap in the associated tunnel, which gap is covered and sealed by a casing.

9. A motorboat as set forth in claim 1, wherein said inlet baffle means is constituted by a first contoured section directing incoming water tangentially toward the lower segment of the wheel and a second contoured section following the curvature of the wheel above the lower segment to isolate the wheel from the incoming water.

10. A motorboat as set forth in claim 1, wherein said outlet baffle means is constituted by a first contoured section directing water discharged from the lower segment of the wheel toward the stern and a second contoured section functioning to isolate the wheel from the water discharged thereby.

* * * * *